US007249396B2

(12) United States Patent
Pischel et al.

(10) Patent No.: US 7,249,396 B2
(45) Date of Patent: Jul. 31, 2007

(54) APPARATUS AT A SPINNING PREPARATION MACHINE, ESPECIALLY A CARDING MACHINE, OPENER, CLEANER OR THE LIKE

(75) Inventors: Robert Pischel, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 410 days.

(21) Appl. No.: 10/912,091

(22) Filed: Aug. 6, 2004

(65) Prior Publication Data

US 2005/0044668 A1 Mar. 3, 2005

(30) Foreign Application Priority Data

Aug. 28, 2003 (DE) ..... 103 40 058

(51) Int. Cl.
*D01G 15/40* (2006.01)

(52) U.S. Cl. ..... 19/105

(58) Field of Classification Search ..... 19/98, 19/105, 112; 403/7, 8

See application file for complete search history.

(56) References Cited

U.S. PATENT DOCUMENTS 521,055 A * 6/1894 Shartle ..... 403/7
587,938 A * 8/1897 Dawes ..... 403/8
4,116,572 A * 9/1978 Heldmann et al. ..... 403/7
4,371,279 A * 2/1983 Prussen et al. ..... 403/8

FOREIGN PATENT DOCUMENTS

DE 1 172 902 A 10/1956

* cited by examiner

*Primary Examiner*—Shaun R. Hurley
(74) *Attorney, Agent, or Firm*—Venable LLP; Robert Kinberg; Ryan M. Flandro

(57) ABSTRACT

In an apparatus at a spinning preparation machine, especially a carding machine, opener, cleaner or the like, an axle, a bearing or the like is fixed in a stationary mounting element by a fastening element. In order to allow, in simple manner, precise adjustment of the axle, the bearing or the like in an axial direction and especially to allow displacement by a small amount, the fastening element is arranged between the curved surface of a body, for example, an axle, bearing or the like, and an internal surface of the mounting element, and is capable of fixing the body by a clamping force and, without the clamping force, is capable of allowing the axle, the bearing or the like to move.

21 Claims, 4 Drawing Sheets

APPARATUS AT A SPINNING PREPARATION MACHINE, ESPECIALLY A CARDING MACHINE, OPENER, CLEANER OR THE LIKE

CROSS REFERENCE TO RELATED APPLICATION

This application claims the priority of German Patent Application No. 103 40 058.3 dated 28 Aug. 2003, the disclosure of which is incorporated herein by reference.

BACKGROUND OF THE INVENTION

The invention relates to an apparatus at a spinning preparation machine, especially a carding machine, opener, cleaner or the like, wherein an axle, a bearing or the like is fixed in a stationary mounting element by a fastening element.

In a known apparatus, a bearing for the shaft of a take-off roller at a carding machine is arranged within the mounting element. In the wall of the mounting element there is a through-hole having an internal thread, which is in engagement with the external thread of a threaded pin. In its curved surface, the housing of the bearing has a recess, into which the head region of the threaded pin extends, thereby securing the bearing against displacement and rotation. In the event of repeated axial displacement of the bearing and re-tightening of the threaded pin, the head region leaves undesirable indentations in the surface of the bearing which, especially when located close by to one another, impair precise adjustment of the bearing in an axial direction.

It is an aim of the invention to provide an apparatus of the kind described at the beginning which avoids or mitigates the mentioned disadvantages and which especially allows, in simple manner, precise adjustment of the axle, the bearing or the like in an axial direction and especially allows displacement by a small amount.

SUMMARY OF THE INVENTION

The invention provides a mounting assembly for use in a spinning preparation machine, comprising:

a stationary mounting member;

a body having a surface, at least a part of said surface being curved; and a fastening element;

wherein the fastening element is so arranged that it can apply a clamping force to a curved surface portion of the body for fixing the body and that, when a clamping is not applied, relative movement of the body and stationary mounting member is permitted.

As a result of the non-positive or friction-based connection or fixing between the fastening element and the body, for example, the axle, the bearing or the like, undesirable indentations, notches or the like in the curved surface of the body, for example, axle, the bearing or the like, can be avoided. As a result, precise displacement in an axial direction even by small or extremely small amounts is made possible by constructionally simple means.

Advantageously, the fastening element is a bolt or the like, having a recess. Advantageously, the recess is in engagement with part of the curved surface of the fastening element. Advantageously, the fastening element is arranged substantially tangentially to the curved surface of the axle. Advantageously, at one end of the fastening element there is provided a thread, which co-operates with a fixing nut.

Advantageously, the fixing nut bears against the mounting element. Advantageously, a washer is provided between the fixing nut and the mounting element. Advantageously, the clamping force is produced by a friction-based connection. Advantageously, the fastening element brings about a non-positive connection between the axle and the mounting element. Advantageously, the fastening element brings about fixing of the axle in a radial and axial direction. Advantageously, without the clamping force, displacement of the axle in an axial direction is possible. Advantageously, without the clamping force, rotation of the axle is possible. Advantageously, the axle is a mounting or part of a mounting for a roller. Advantageously, the roller is a take-off roller (calender roller) of a carding machine. Advantageously, two co-operating take-off rollers are provided, an apparatus having a displaced axle being associated with at least one take-off roller. Advantageously, a gap is present in a radial direction between the take-off rollers, the size of which gap is arranged to be adjusted by displacement of at least one apparatus having a pre-mounted axle. Advantageously, the axle, the bearing or the like is cylindrical. Advantageously, the mounting is in the shape of a hollow cylinder. Advantageously, the axle of the take-off rollers is rotatably mounted in the bearing.

DESCRIPTION OF PREFERRED EMBODIMENTS

Figure 1:
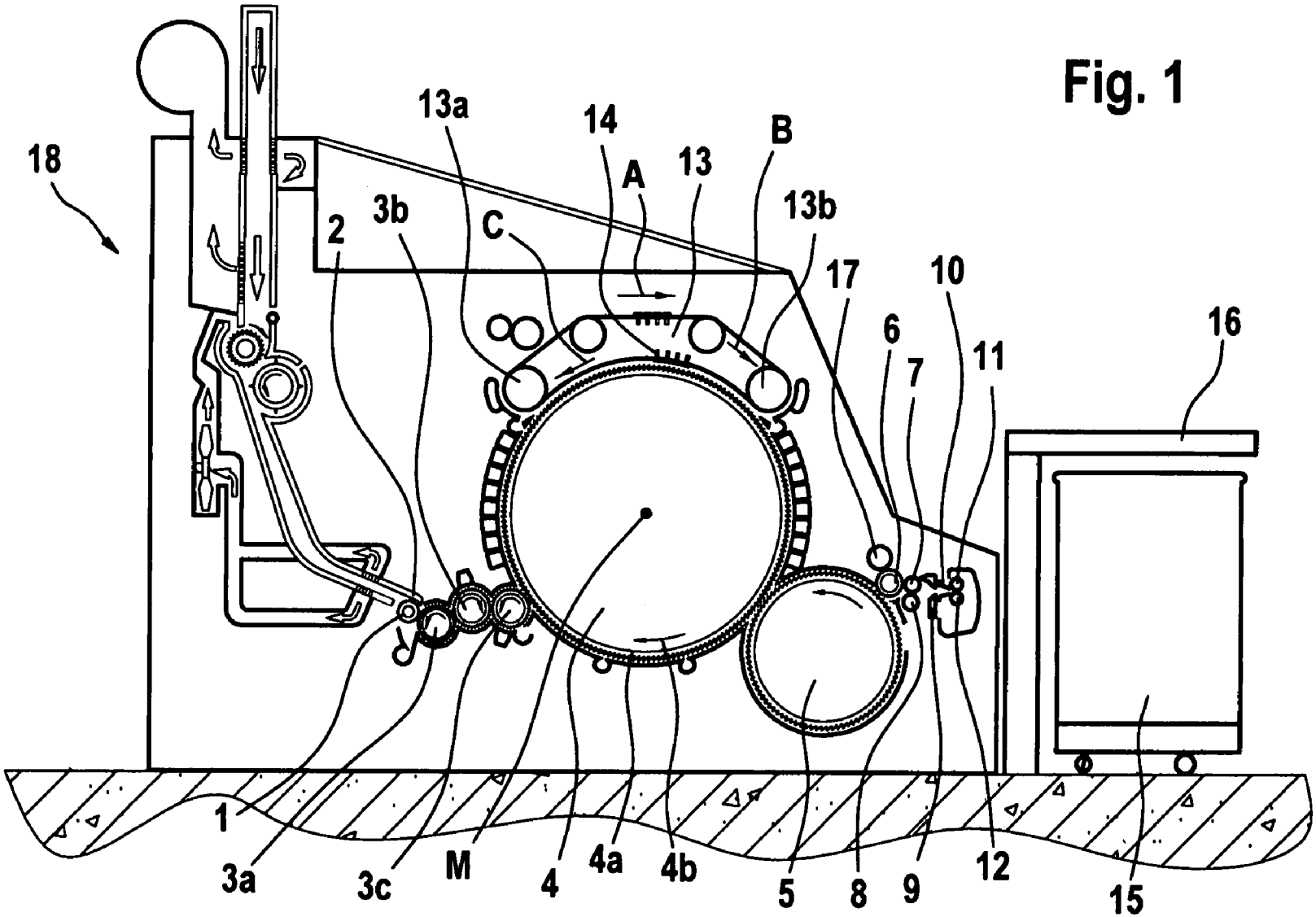
FIG. 1 is a diagrammatic side view of a carding machine having an apparatus according to the invention.

With reference to FIG. 1, a carding machine, for example a TC 03 (Trade Mark) carding machine made by Trützschler GmbH & Co. KG, has a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter C denotes the direction of rotation of the revolving card top 13 at the carding location and reference letter B denotes the direction in which the card top bars 14 are moved on the reverse side. Reference numeral 18 denotes a card feeder.

Figure 2:
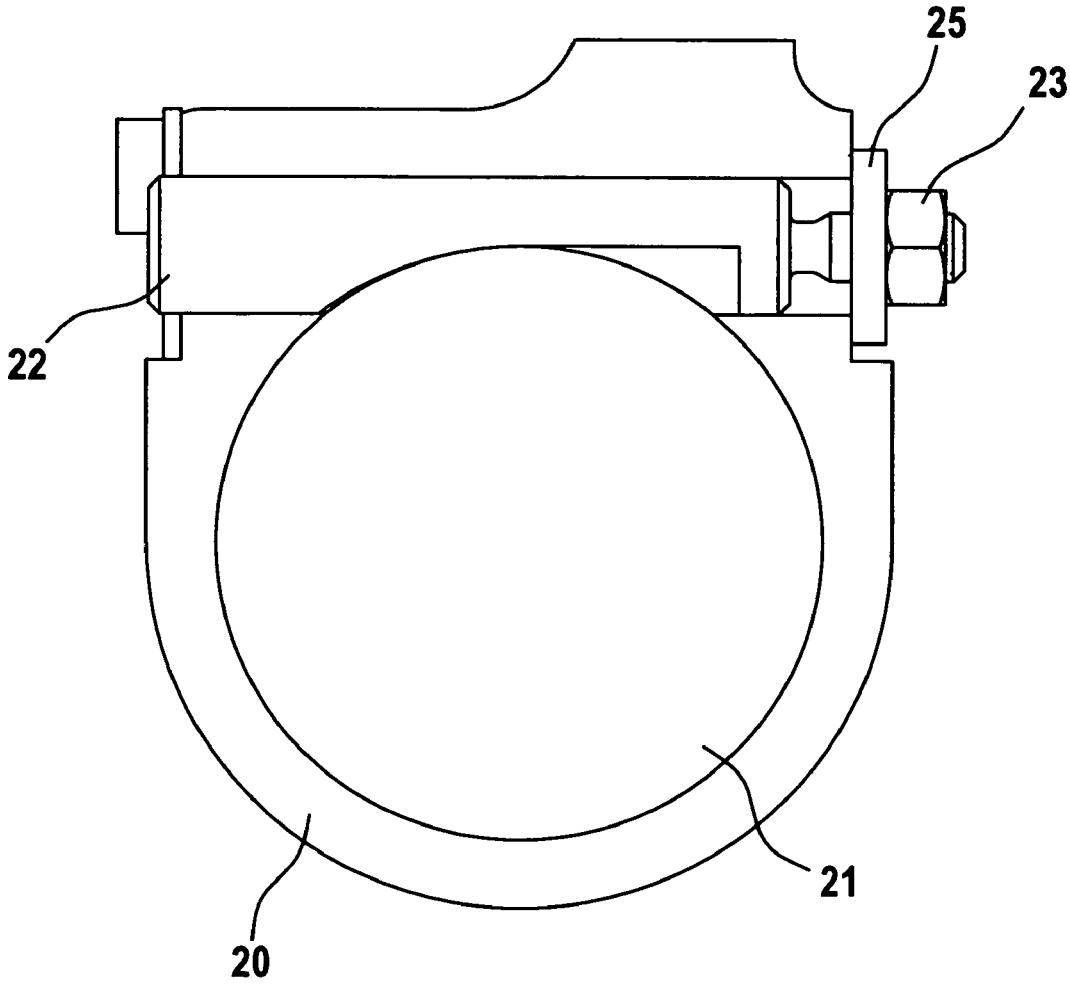
FIG. 2 is a side view of a mounting member, axle and fastening element.

Referring to FIG. 2, between the curved surface of an axle 21 and the internal surface of a mounting member 20 there is arranged a bolt-shaped fastening element 22, which has a recess. Part of the internal surface of the recess is curved, the radii of curvature of the internal surface of the recess and of the curved surface of the axle 21 being the same. Another part of the recess has an internal wall surface that is arranged spaced away from the curved surface of the axle 21, thereby forming a clearance. At one end of the fastening element 22 there is provided a thread 24 (see FIG. 3*b*), which co-operates with a fixing nut 23. The fixing nut 23 bears against the mounting member 20 by way of a washer 25. When the fixing nut 23 is tightened, the curved internal surface of the recess presses tightly against the curved surface of the axle 21, as a result of which the axle 21 is fixed in a stationary (non-rotatable and non-displaceable) position.

Figure 3A:
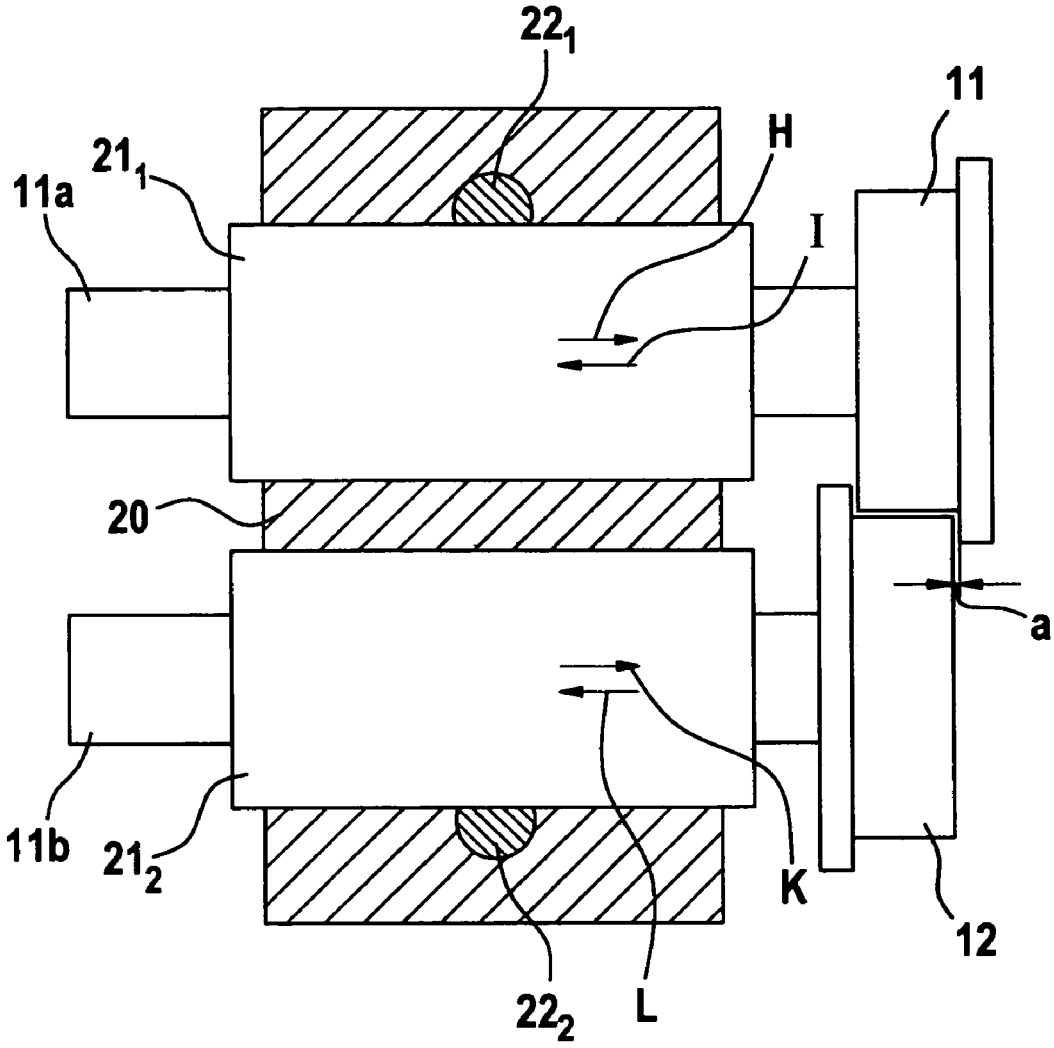
FIG. 3*a* is a front view of a take-off roller device at the exit from a carding machine, comprising two take-off rollers with their respective bearings, which are mounted in a mounting member, and respective fastening elements.
Figure 3B:
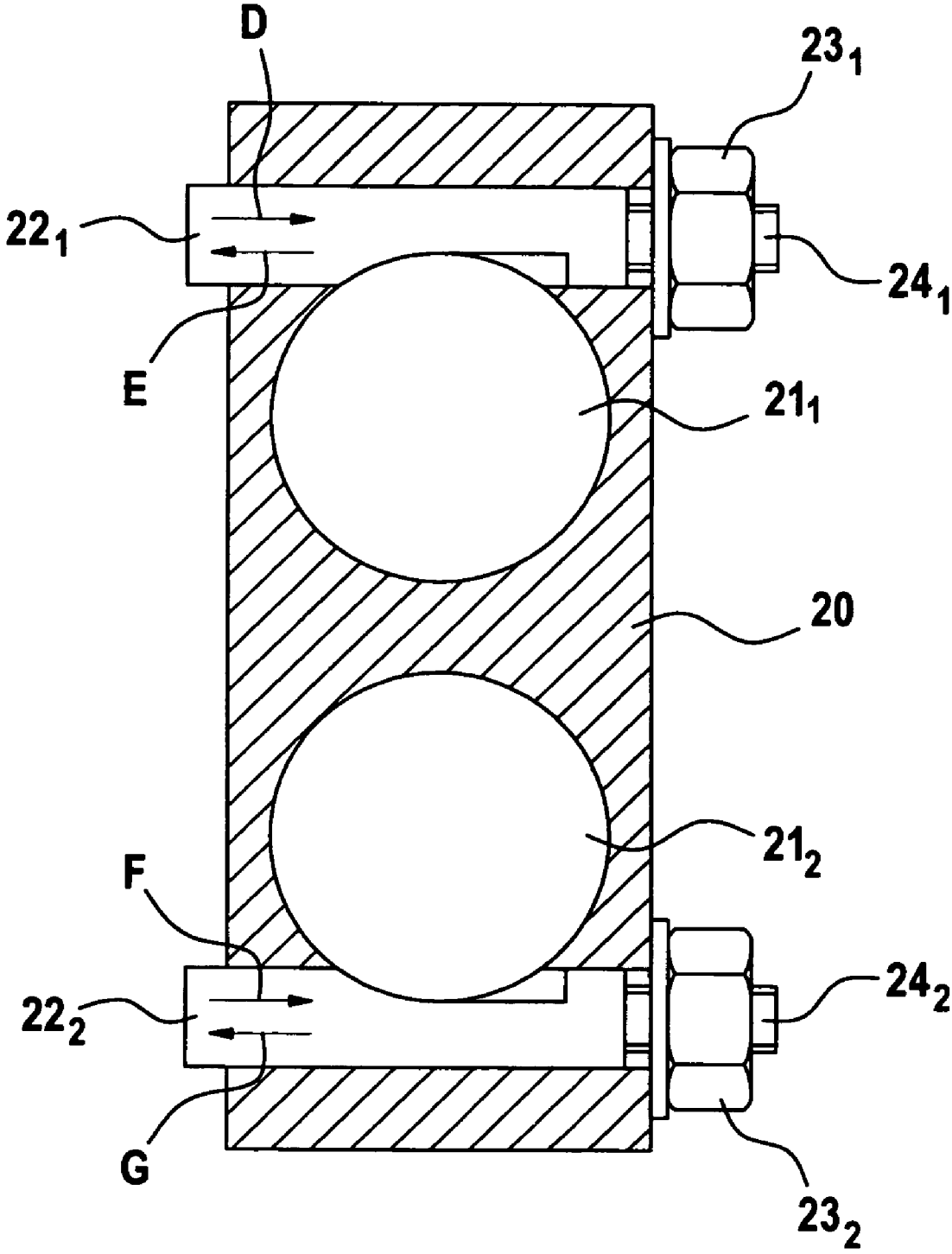
FIG. 3*b* is a side view of the apparatus according to FIG. 3*a*.

In the embodiment of FIG. 3*a*, two bearing members $\mathbf{21}_1$ and $\mathbf{21}_2$ are arranged one above the other in a stationary mounting member. The mounting member 20 is fastened to the machine frame at the exit from a carding machine (see FIG. 1). Inside the bearing members $\mathbf{21}_1$ and $\mathbf{21}_2$, shafts 11*a* and 11*b*, respectively, are rotatably mounted, to one end of which there are fixed two respective take-off rollers 11 and 12. The take-off rollers 11 and 12 are in the form of stepped rollers, having a spacing a with respect to one another in the direction of the axes of the shafts 11*a*, 11*b*. As FIG. 3*b* shows, the fastening element $\mathbf{22}_1$ is associated with the bearing member $\mathbf{21}_1$ and the fastening element $\mathbf{22}_2$ is associated with the bearing member $\mathbf{21}_2$. (The fastening elements $\mathbf{22}_1$ and $\mathbf{22}_2$ correspond to the fastening element 22 shown in FIG. 2). When the fastening bolts $\mathbf{24}_1$ and $\mathbf{24}_2$ are tightened, the fastening elements $\mathbf{22}_1$ and $\mathbf{22}_2$, respectively, are displaced in the direction of the arrows D and F, respectively, until the curved recesses press against the curved surfaces of the bearing members $\mathbf{21}_1$ and $\mathbf{22}_2$, respectively, as a result of which the bearing members $\mathbf{21}_1$ and $\mathbf{21}_2$ are secured against rotation and axial displacement. When the fastening bolts $\mathbf{24}_1$ and $\mathbf{24}_2$ are slackened (unscrewed), the fastening elements $\mathbf{22}_1$ and $\mathbf{22}_2$, respectively, are displaced in the direction of arrows E and G, respectively, so that the clamping or pressing between the curved recesses of the fastening elements $\mathbf{22}_1$ and $\mathbf{22}_2$ and the curved surfaces of the bearing members $\mathbf{21}_1$ and $\mathbf{21}_2$, respectively, is removed or released. As a result, in accordance with FIG. 3*a*, axial displacement of the bearing member $\mathbf{21}_1$ and of the bearing member $\mathbf{21}_2$ is possible in the direction of arrows H, I and K, L, respectively. By that means, the spacing a between the take-off rollers 11 and 12 can be modified or adjusted.

Although the foregoing invention has been described in detail by way of illustration and example for purposes of understanding, it will be obvious that changes and modifications may be practised within the scope of the appended claims.

What is claimed is:

1. A mounting assembly for use in a spinning preparation machine, comprising:

a stationary mounting member;

a body having a surface, at least a part of said surface being curved; and a fastening element comprising an elongated portion having a peripheral recess configured for engaging a portion of the curved surface of the body;

wherein an internal surface of the recess of the fastening element is so arranged that it can apply a clamping force to the portion of the curved surface of the body for fixing the body and that, when a clamping is not applied, relative movement of the body with respect to the stationary mounting member is permitted.

2. An assembly according to claim 1, in which the fastening element is arranged between the curved surface of the body and an internal surface of the stationary mounting member.

3. An assembly according to claim 1, in which the body is a bearing or a part of a bearing for a roller.

4. An assembly according to claim 1, in which the body is a journal of a roller.

5. An assembly according to claim 1, in which the fastening element extends substantially tangentially to the curved surface of the body.

6. An assembly according to claim 1, in which at one end of the fastening element there is provided a thread, which co-operates with a fixing nut.

7. An assembly according to claim 6, in which the fixing nut bears against the mounting member.

8. An assembly according to claim 6, in which a washer is provided between the fixing nut and the mounting element.

9. An assembly according to claim 1, in which the clamping force comprises a frictional interaction between the body and the mounting member.

10. An assembly according to claim 1, in which the fastening element brings about a non-positive engagement between the axle and the mounting element.

11. An assembly according to claim 1, in which the fastening element effects fixing of the axle in a radial and axial direction.

12. An assembly according to claim 1, in which, when the clamping force is not applied, displacement of the body in an axial direction is possible.

13. An assembly according to claim 1, in which, when the clamping force is not applied, rotation of the body is possible.

14. An assembly according to claim 1, further comprising a take-off roller (calendar roller) of a carding machine, the body being a bearing member of said take-off roller.

15. An assembly according to claim 1, comprising two co-operating take-off rollers of a carding machine, the body being a bearing member of at least one of said take-off rollers.

16. An assembly according to claim 15, in which a first said take-off roller is axially displaceable relative to a second said take-off roller.

17. An assembly according to claim 1, in which the body is cylindrical.

18. An assembly according to claim 1, in which the body is in the shape of a hollow cylinder.

19. An assembly according to claim 1, in which the body is a roller bearing in which an axle of a take-off roller can be rotatably mounted.

20. An assembly according to claim 1, wherein at least a portion of the internal surface of the recess of the fastening element is curved.

21. An assembly according to claim 20, wherein a radius of the curved portion of the internal surface of the recess of the fastening element is substantially equal to a radius of the curved surface of the body.

* * * * *